US006376973B1

(12) United States Patent
Blanchet-Fincher et al.

(10) Patent No.: US 6,376,973 B1
(45) Date of Patent: Apr. 23, 2002

(54) METAL-OXYGEN-CARBON FIELD EMITTERS

(75) Inventors: Graciela Beatriz Blanchet-Fincher, Greenville, DE (US); John Gerard Lavin, Swarthmore, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/402,287

(22) Filed: Oct. 1, 1999

Related U.S. Application Data

(60) Provisional application No. 60/042,185, filed on Apr. 2, 1997.

(51) Int. Cl.[7] ..... H01J 1/30; H01J 1/02

(52) U.S. Cl. ..... 313/309; 313/310; 313/311; 313/336; 313/346 R; 313/495; 313/496

(58) Field of Search ..... 313/309, 310, 313/311, 495, 496, 346 R, 336, 351, 491, 326, 352, 341

(56) References Cited

U.S. PATENT DOCUMENTS

| | | | | | |
|---|---|---|---|---|---|
| 3,866,077 | A | | 2/1975 | Baker et al. | 313/336 |
| 4,857,799 | A | | 8/1989 | Spindt et al. | 313/495 |
| 4,933,108 | A | * | 6/1990 | Soredal | 252/518 |
| 5,015,912 | A | | 5/1991 | Spindt et al. | 313/495 |
| 6,020,677 | A | * | 2/2000 | Blanchet-Fincher et al. | 313/336 |
| 6,051,165 | A | * | 4/2000 | Billings | 252/515 |
| 6,184,610 | B1 | * | 2/2001 | Shibata et al. | 313/309 |

FOREIGN PATENT DOCUMENTS

| | | | | |
|---|---|---|---|---|
| JP | 60086728 | * | 5/1985 | H01J/1/14 |
| JP | 60 091528 A | | 5/1985 | H01J/1/30 |
| WO | WO 94/15350 | | 7/1994 | H01J/1/62 |
| WO | WO 94/15352 | | 7/1994 | H01J/19/24 |
| WO | WO 94/28571 | | 12/1994 | H01J/19/24 |
| WO | WO 95/02256 A | | 1/1995 | H01J/1/14 |

OTHER PUBLICATIONS

R. S. Robinson et al., *J. Vac. Sci. Technolo.*, 21(3), 790, 1982.

J. A. Floro, S. M. Rossnagel, R. S. Robinson, *J. Vac. Sci. Technolo.*, A1 (30), 1398, 1983.

J. A. van Vechten, W. Solberg, P. E. Batson, J. J. Cuomo, S. M. Rossnagel, *J. Crystal Growth*, 82, 289, 1987.

M. S. Dresselhaus, G. Dresselhaus, K. Sugihara, I. L. Spain, H. A. Goldberg, Graphite Fibers and Filaments, *Springer–Verlag, Berlin*, 32–34, 1988.

* cited by examiner

*Primary Examiner*—Nimeshkumar D. Patel
*Assistant Examiner*—Sikha Roy

(57) ABSTRACT

Metal-oxygen-carbon field emission electron emitter compositions and field emission cathodes made thereform are disclosed. A process for making metal-oxygen-carbon whisker field emitters is also provided, wherein a metal substrate (e.g., tungsten wire) is coated with an organic polymer and heated to a temperature of from about 1100° C. to about 1550° C. in an inert atmosphere for about 15 minutes to about two (2) hours. The heating temperature can be reduced when heating is carried out in the presence of a catalyst, such as a copper-nickel alloy catalyst. The emitter compositions and field emission cathodes of the invention are useful in vacuum electronic applications and devices (e.g., flat panel displays).

9 Claims, 12 Drawing Sheets

METAL-OXYGEN-CARBON FIELD EMITTERS

CROSS-REFERENCE TO RELATED APPLICATIONS

This application claims the benefit of U.S. Provisional Application 60/042,185, filed Apr. 2, 1997 and PCT International Application PCT/US98/06369, filed Apr. 1, 1998, wherein the United States was a designated country.

FIELD OF THE INVENTION

The invention generally relates to metal-oxygen-carbon field emitters and particularly to their use in a field emitter cathode for display panels. A process for making metal-oxygen-carbon whisker field emitters is also provided.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, and klystrons and in lighting.

Display panels are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently, laptop computer flat panel displays use liquid crystals which can be switched from a transparent state to an opaque one by the application of small electrical signals. It is difficult to reliably produce these displays in sizes larger than that suitable for laptop computers.

Plasma displays have been proposed as an alternative to liquid crystal displays. A plasma display uses tiny cells of electrically charged gases to produce an image and requires relatively large electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth, weight and power consumption advantages of the other flat panel displays. U.S. Pat. Nos. 4,857,799 and 5,015,912 disclose matrix-addressed flat panel displays using micro-tip cathodes constructed of tungsten, molybdenum or silicon. WO 94-15352, WO 94-15350 and WO 94-28571 disclose flat panel displays wherein the cathodes have relatively flat emission surfaces.

R. S. Robinson et al., J. Vac. Sci. Technolo. 21 (3), 790 (1982) disclose the formation of cones on the surfaces of substrates under ion bombardment. The effect was reported for various substrate materials and the cones were generated by simultaneously sputtering a surface at high energy while seeding it with impurity atoms deposited at low energy. They also disclosed the formation of carbon whiskers up to 50 $\mu$m in length when a graphite substrate was ion-bombarded with impurities from a stainless steel target.

J. A. Floro, S. M. Rossnagel, and R. S. Robinson, J. Vac. Sci. Technolo. A 1 (30), 1398 (1983) disclose the formation of whiskers during relatively high current density ion bombardment of heated graphite substrates. The whiskers were disclosed to be 2–50 $\mu$m in length and 0.05–0.5 $\mu$m in diameter and to grow parallel to the ion beam. Simultaneous impurity seeding was reported to inhibit whisker growth.

J. A. van Vechten, W. Solberg, P. E. Batson, J. J. Cuomo, and S. M. Rossnagel, J. Crystal Growth 82, 289 (1987) discuss the growth of whiskers from graphite surfaces under ion sputtering conditions. They note that the whiskers of smallest diameter, characteristically about 15 nm, definitely appear to be different from either diamond or the scrolled-graphite structure found in carbon fibers grown by catalytic pyrolysis of hydrocarbons. Larger whiskers with diameters ranging from 30 to 100 nm were also observed to grow in sputtering systems. The smaller diameter whiskers are constant in diameter along the length while the larger diameter whiskers may have a slight taper.

M. S. Dresselhaus, G. Dresselhaus, K. Sugihara, I. L. Spain, and H. A. Goldberg, Graphite Fibers and Filaments (Springer-Verlag, Berlin, 1988), pp. 32–34, disclose that filaments may be grown on several types of hexagonal carbon surfaces, but not on diamond or glassy carbon.

In view of the above, improved field emission materials are needed for use in field emitter cathodes for display panels and other electronic devices. Other objects and advantages of the present invention will become apparent to those skilled in the art upon reference to the attached drawings and to the detailed description of the invention which hereinafter follows.

SUMMARY OF THE INVENTION

The invention provides a field emission electron emitter composition comprising metal, oxygen and carbon, wherein the atomic ratio of metal:oxygen:carbon is a:b:c where a is from about 0.1 to about 0.4, b is from about 0.1 to about 0.8 and c is from about 0.05 to about 0.8 with the proviso that a+b+c=1.

The invention also provides a field emission cathode comprising a metal, oxygen and carbon field emission electron emitter composition, as described above, attached to a metal substrate. Preferably, the field emission electron emitter composition is in the form of whiskers. Preferably, a is from about 0.2 to about 0.4, b is from about 0.4 to about 0.8 and c is from about 0.05 to about 0.3. Preferably the metal is tungsten, iron or molybdenum.

A process for making the metal-oxygen-carbon whiskers of the invention is also provided. The process comprises heating a metal substrate, preferably a metal wire, coated with an organic polymer, such as polyacrylonitrile (PAN), to a temperature of from about 1100° C. to about 1550° C. in an inert atmosphere and maintaining that temperature for about 15 minutes to about two (2) hours. Preferably, the temperature is from about 1150° C. to about 1300° C. and the atmosphere comprises argon. When the heating is carried out in the presence of a catalyst, temperatures as low as 550° C. can be used with heating times up to three (3) hours. Suitable catalysts include nickel, copper-nickel alloys and cobalt-nickel alloys.

The field emission electron emitter compositions and field emission cathodes are useful in vacuum electronic devices, flat panel computer and television displays and other large screen applications, emission gate amplifiers, klystrons and lighting devices. As used herein, the term "display panel" embraces planar (e.g., flat panel displays) and curved surfaces as well as other possible geometries).

DETAILED DESCRIPTION OF THE PREFERRED EMBODIMENTS

Figure 1A:
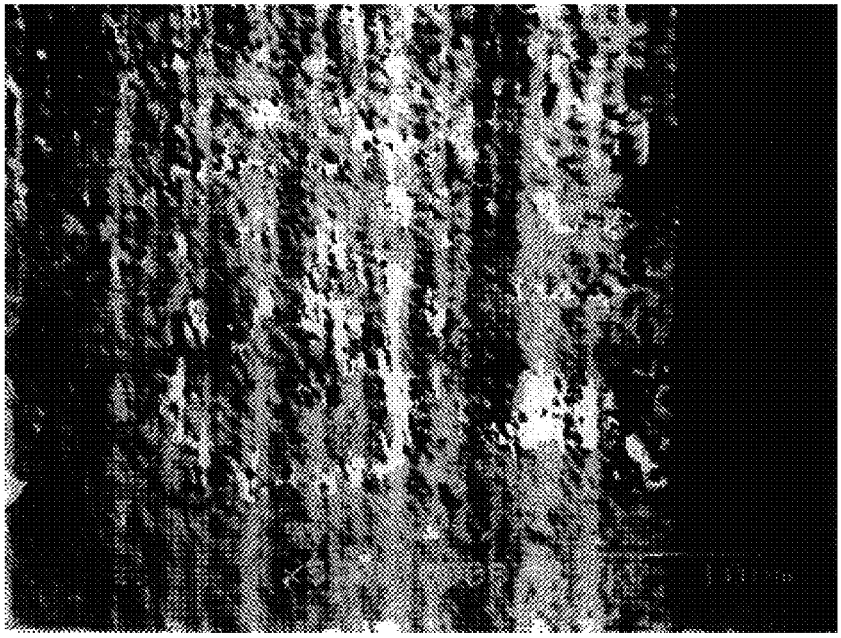
FIG. 1 shows the scanning electron micrographs of polyacrylonitrile coated tungsten wires after being heated to various temperatures.
Figure 1B:
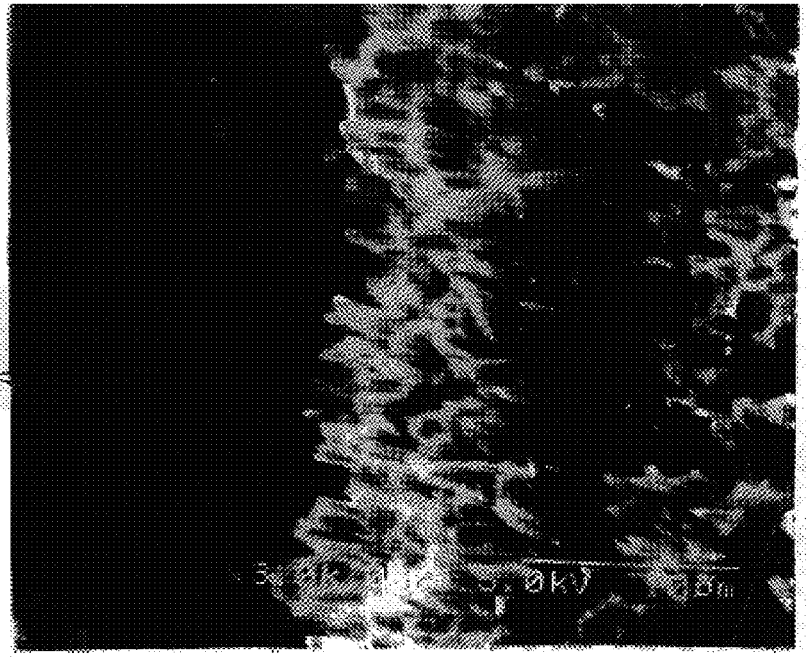
Figure 1C:
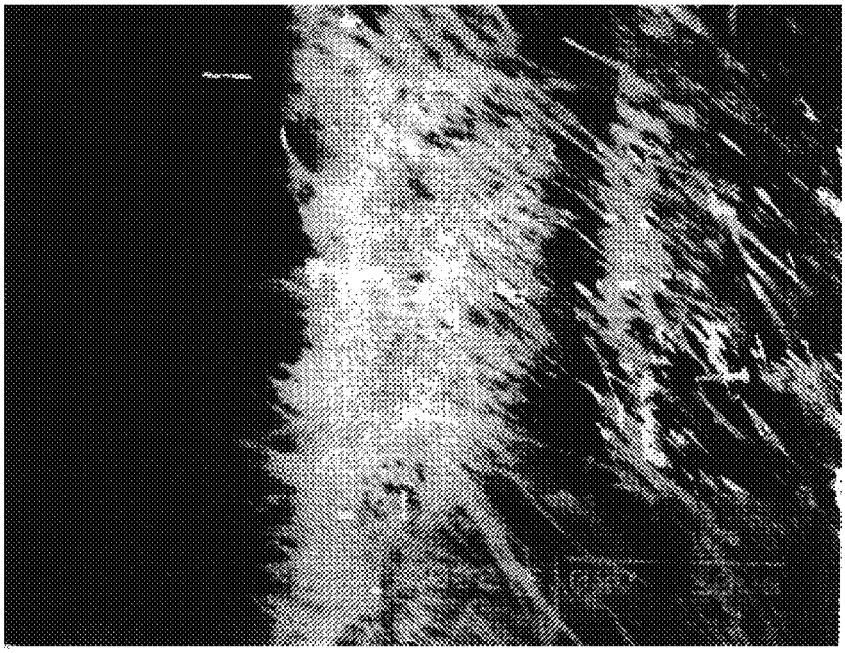
Figure 1D:
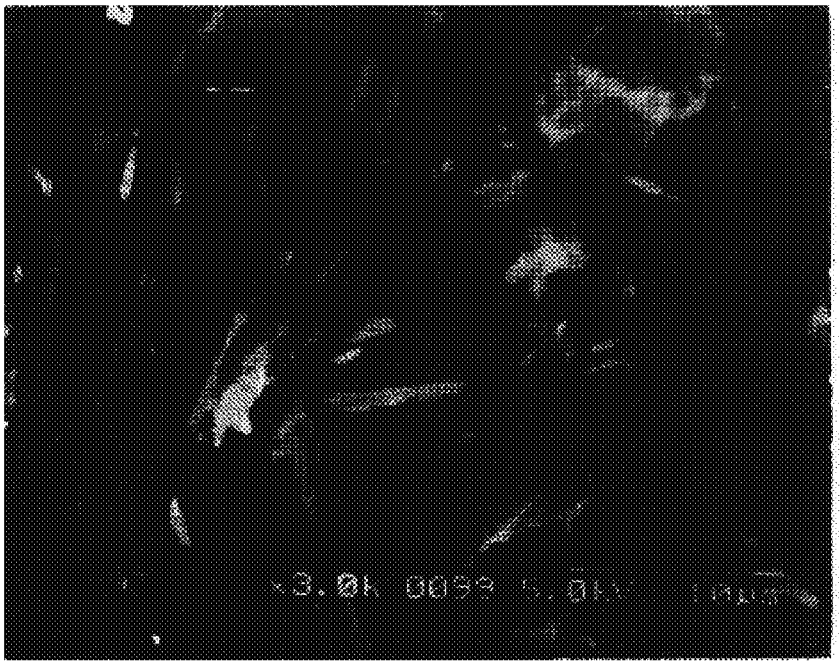

The metal-oxygen-carbon whiskers useful as electron emitters in the invention can be formed by coating a metal substrate (e.g., metal wire) with an organic polymer and heating the coated wire, e.g., by coating the wire with a polyacrylonitrile (PAN) solution and heating the PAN coated wire to form the whiskers. Wires containing such whiskers are especially useful in fibrous field emission cathodes in which each fiber or wire of the fibrous cathode lies essentially in the plane of the cathode so that electron emission occurs along the length of the fiber or wire and not from the tip or end of the fiber or wire. The heating of the PAN coated wire to form the whiskers can be carried out before or after the wires are positioned on the cathode structure.

Prior to the application of the PAN solution coating, the metal wire is cleaned in 30 wt. % nitric acid solution for 30 minutes followed by de-ionized water, acetone and methanol rinses. Preferably, the metal is tungsten, iron or molybdenum. PAN is preferably coated onto the wire from a solution of polyacrylonitrile in dimethyl sulfoxide. The heated solution is stirred until the polymer is fully dissolved and then cooled to ambient temperature. The viscous PAN solution is then applied to the clean metal wire with a small brush. The wire coated with the PAN layer is stabilized, typically, by heating in an oven to 250° C. and maintaining that temperature for about 30 minutes. A second layer of PAN solution is then applied to the PAN-coated wire and again stabilization is accomplished by heating in an oven to 250° C. and maintaining that temperature for about 30 minutes.

The PAN-coated wire is then heated to a temperature of from about 1100° C. to about 1550° C. and maintained at that temperature for about 15 minutes to about two (2) hours to form the metal-oxygen-carbon whiskers. This heating is carried out in an atmosphere of an inert gas, such as argon, in an atmosphere of ethylene. carbon monoxide or carbon dioxide or in an atmosphere comprising mixtures of these gases.

The formation of the metal-oxygen-carbon whiskers can be carried out at lower temperatures in the presence of a catalyst such as a copper-nickel alloy, a cobalt-nickel alloy or nickel. Temperatures as low as 550° C. can be used with these catalysts with heating times up to about three (3) hours.

The surface structure of the wire changes significantly during heating. As a consequence of heating, the surface is no longer smooth, but instead is comprised of metal-oxygen-carbon whiskers attached to the metal wire. The density or spacing of these whiskers and their shape depend on the heating conditions. The lengths of the metal-oxygen-carbon whiskers can extend from less than 2 $\mu$m to 20 $\mu$m or more. Diameters of the whiskers are typically in the range of about 1 nm to about 1 $\mu$m.

Electron emission from wires containing metal-oxygen-carbon whiskers was measured in a cylindrical test fixture. In this fixture, the conducting wire to be tested served as the cathode and is mounted in the center of a cylinder which served as the anode. This anode cylinder typically consists of a fine mesh cylindrical metal screen coated with a phosphor. Both the cathode and anode are held in place by an aluminum block with a semi-cylindrical hole cut therein.

In use, the conducting wire is held in place by two 1/16 inch-diameter stainless steel tubes, one at each end. These tubes are cut open at each end, forming an open trough in the shape of a half cylinder of length ½ inch and diameter 1/16 inch, and the wire is placed in the open trough that results and held in place with silver paste. The connecting tubes are held in place within the aluminum block by tight fitting polytetrafluoroethylene (PTFE) spacers, which serve to electrically separate the anode and cathode. The total length of exposed wire is generally set at 1.0 cm, although shorter or longer lengths could be studied by controlling the placement of the holder tubes. The cylindrical screen mesh anode is placed in the semi-cylindrical trough in the aluminum block and held in place with copper tape. The cathode is in electrical contact with the aluminum block.

Electrical leads are connected to both the anode and cathode. The anode is maintained at ground potential (0 V) and the voltage of the cathode is controlled with a 0–10 kV power supply. Electrical current emitted by the cathode is collected at the anode and measured with an electrometer. The electrometer is protected from damaging current spikes by an in-series 1 M½ resistor and in-parallel diodes which allow high current spikes to bypass the electrometer to ground.

Samples for measurement of about 2 cm in length are cut from longer lengths of wire. With the cylindrical screen mesh anode removed, the samples are inserted into the cylindrical troughs of the two holder arms. Silver paste is applied to hold them in place. The silver paste is allowed to dry and the cylindrical screen mesh anode is reattached and held in place with copper tape at both ends. The test apparatus is inserted into a vacuum system, and the system is evacuated to a base pressure below $1\times10^{-6}$ torr ($1.3\times10^{-4}$ Pa).

Emission current is measured as a function of applied voltage. Electrons emitted from the cathode create light when they strike the phosphor on the anode. The distribution and intensity of electron emission sites on the wire can be observed by the pattern of light created on the phosphor/wire mesh screen. The average electric field (E) at the wire surface is calculated through the relationship $E=V/[a \ln(b/a)]$, where V is the voltage difference between the anode and cathode, a is the wire radius, and b is the radius of the cylindrical screen mesh anode. Typically, measurements are recorded at 25 V increments. At each voltage, 10 individual measurements of emission current are made and the results are averaged. Typically; the sample is cycled 2 times from the lowest to the highest emission currents (usually 1 nA to 100–500 $\mu$A).

The metal-oxygen-carbon whiskers produced provide good emission and can be formed on metal substrate surfaces other than wires. Thus, the invention is applicable to both planar and fibrous/wire substrates as well as other possible geometries.

The metal surface can be a single metal or a metal alloy in the form of a wire or a sheet. Alternatively, the metal surface can be thick film conductor material such as that obtained using diffusion patterning techniques (e.g., the Diffusion Patterning™ system QM14 Ag or QM17 Ag/Pt imaging pastes (commercially available from E. I. du Pont de Nemours and Company, Wilmington, Del.) or photoprintable compositions such as FODEL® 5956 gold conductor composition (commercially available from E. I. du Pont de Nemours and Company, Wilmington, Del.).

EXAMPLES

The following non-limiting inventive examples and comparative experiments are provided to further illustrate and describe the invention. All percentages are by weight unless otherwise stated.

Examples 1–4 and Comparative Experiment A

These Examples and Comparative Experiment A show the dependence of formation of the tungsten-oxygen-carbon whiskers on the temperature of the heating and the improved emission properties associated with whisker formation.

Tungsten wires 4 mil (0.1 mm) in diameter were cleaned in 30 wt. % nitric acid solution for 30 minutes followed by abundant deionized water, acetone and methanol rinses. The polyacrylonitrile layer was coated onto the wires from solution. The solution was prepared by mixing 8 g of polyacrylonitrile (PAN) (commercially available from Aldrich, Milwaukee, Wis.) into 100 g of dimethyl sulfoxide at 80° C. The heated solution was stirred until the polymer was fully dissolved and then cooled to ambient temperature. The resulting viscous PAN solution was then applied to the clean tungsten wires with a small brush. The PAN layer coating on each wire was stabilized by heating in an oven at 250° C. for 30 minutes in air. A second PAN layer was brushed onto the stabilized first layer of each wire. Stabilization of the second PAN layer was carried out by heating in an oven at 250° C. for 30 minutes in air.

The wire samples with stabilized PAN were placed in a 6 inch (15 cm) long ceramic crucible and heated in a tube furnace in an argon atmosphere for 30 minutes. Only the temperature to which the samples were heated differ. The sample of Comparative Experiment A was heated to 1000° C. and those of Examples 1–4 were heated to temperatures of 1100° C. (Example 1), 1250° C. (Example 2), 1400° C. (Example 3) and 1550° C. (Example 4), respectively. No catalyst was present in any of these samples.

The scanning electron micrographs of FIG. 1 (1*a*—Comparative Experiment A, 1*b*—Example 1, 1*c*—Example 3, 1*d*—Example 4) show that the formation of tungsten-oxygen-carbon whiskers as well as their diameter, length and orientation depend on the heating temperature. No whiskers have formed on the wire of Comparative Experiment A which was heated to 1000° C. Whiskers were formed during the heating on the samples of Examples 1–4 which were heated to temperatures above 1000° C.; these whiskers are firmly attached to the tungsten wire. Whiskers were formed for Example 1 which was heated to 1100° C. As the temperature of heating is increased the thickness or diameter of the whiskers is reduced and they are mainly perpendicular to the surface of the wire, i.e., aligned along extended radii of the wire. As the temperature of heating is increased further, the thickness or diameter of the whiskers is increased and the whiskers tend to lie along or tangent to the surface of the wire pointing in various directions.

Figure 2:
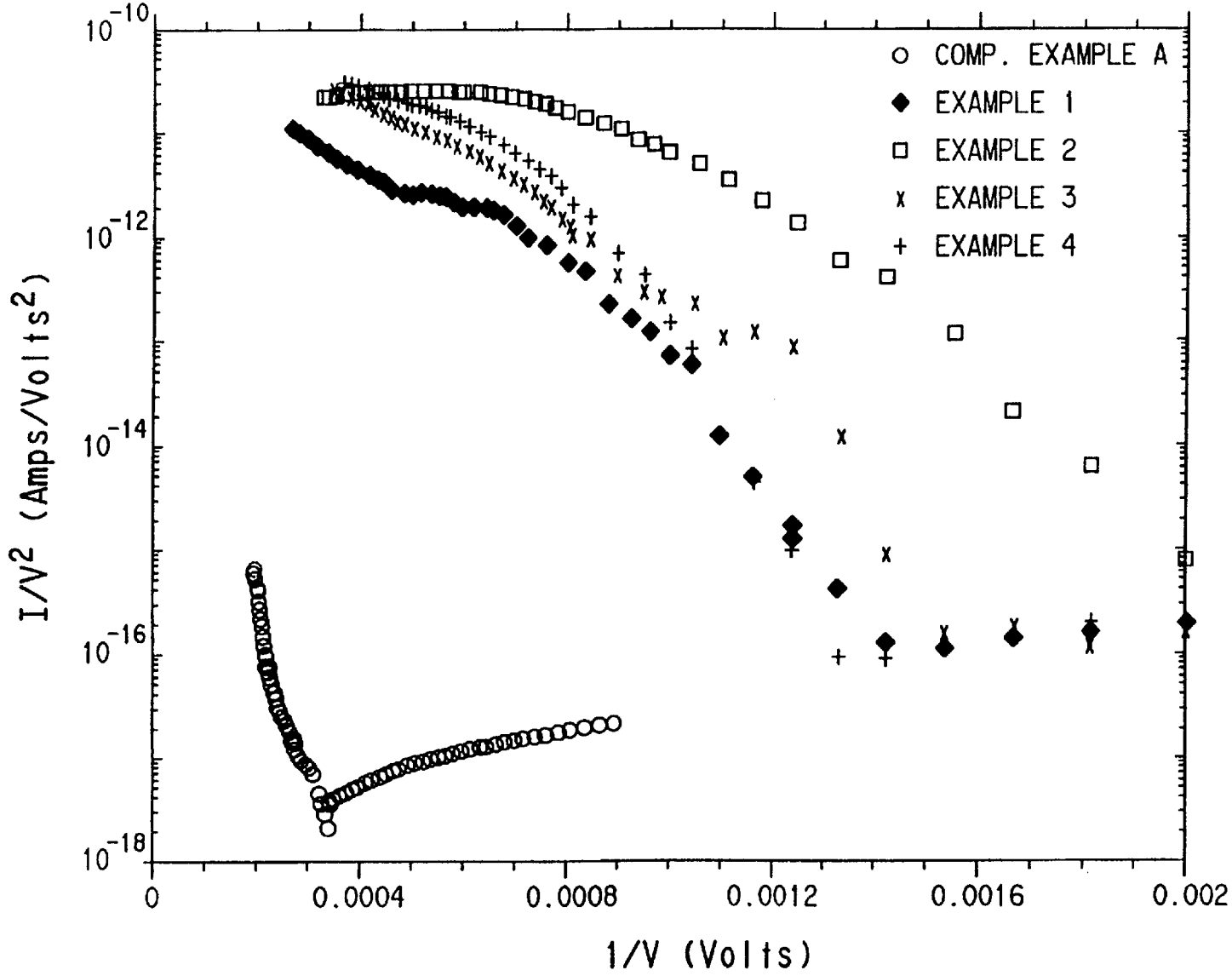
FIG. 2 is a plot of emission characteristics for the wires shown in FIG. 1.

Electron emission was then measured in the cylindrical test fixture described previously. The length of exposed whisker-coated wire was 1 cm. Emission characteristics for the samples of Examples 1–4 and Comparative Experiment A are shown in FIG. 2 and demonstrate the improved emission properties resulting from the tungsten-oxygen-carbon whiskers.

Examples 5–6

These Examples show the effect of wire diameter on the electron emission characteristics of the tungsten-oxygen-carbon whiskers.

Tungsten wire 2 mil (0.05 mm) and 4 mil (0.1 mm) in diameter was used for the samples of Examples 5 and 6, respectively. The tungsten wire was cleaned and coated with a PAN layer and the PAN layer stabilized essentially as described in Examples 1–4 and Comparative Experiment A.

Figure 3A:
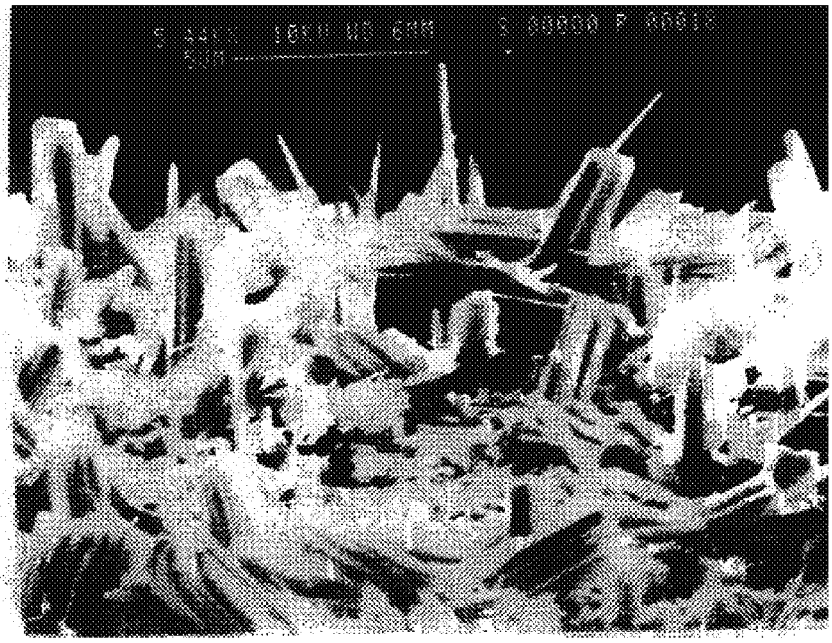
FIG. 3 shows the scanning electron micrographs of polyacrylonitrile coated tungsten wires after being heated to 1 300° C to form tungsten-oxygen-carbon whiskers.
Figure 3B:
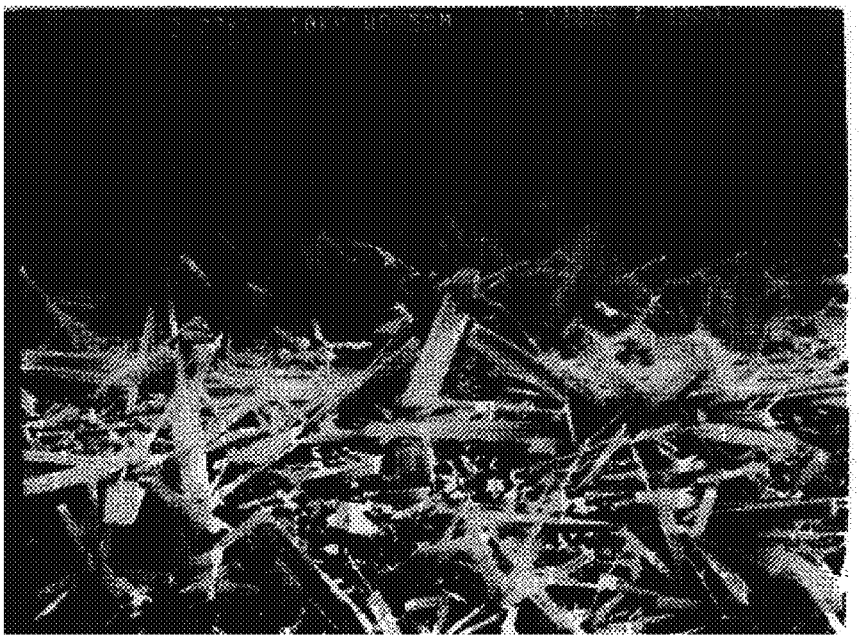

The wire samples with the stabilized PAN coatings were placed in a 6 inch (15 cm) long ceramic crucible and heated in a tube furnace in an argon atmosphere to a temperature of 1300° C. and maintained at that temperature for 30 minutes to form the tungsten-oxygen-carbon whiskers. The scanning electron micrographs for the sample of Example 5 (FIG. 3*a*) and that for Example 6 (FIG. 3*b*) clearly show whiskers of various diameters, lengths and orientations on both the 2 mil (0.05 mm) and 4 mil (0.1 mm) tungsten wire.

Figure 4:
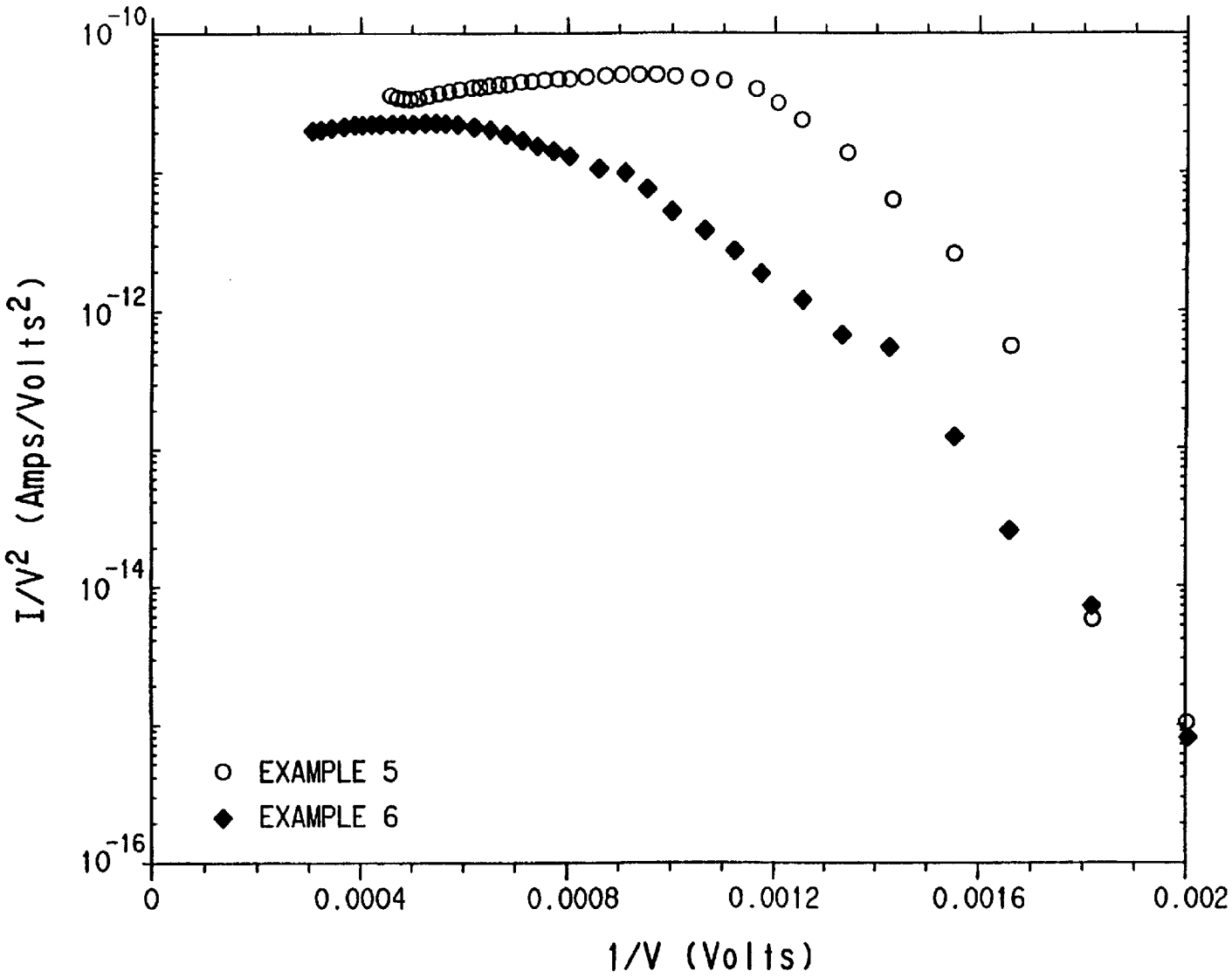
FIG. 4 is a plot of emission characteristics for the tungsten-oxygen-carbon whisker-coated tungsten wires shown in FIG. 3.
Figure 5A:
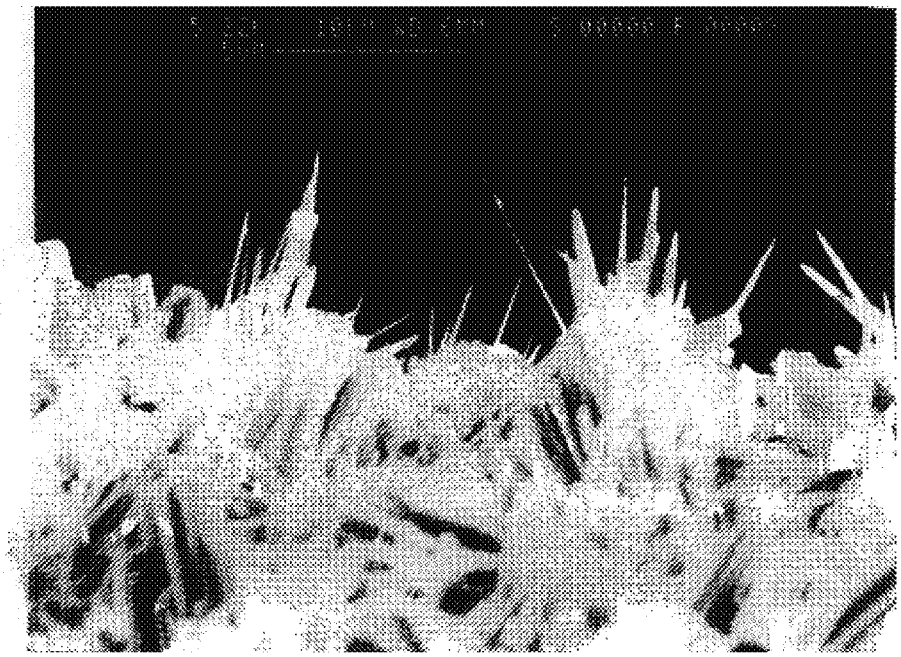
FIG. 5 shows the scanning electron micrographs of polyacrylonitrile coated iron wires after being heated to form iron-oxygen-carbon whiskers.
Figure 5B:
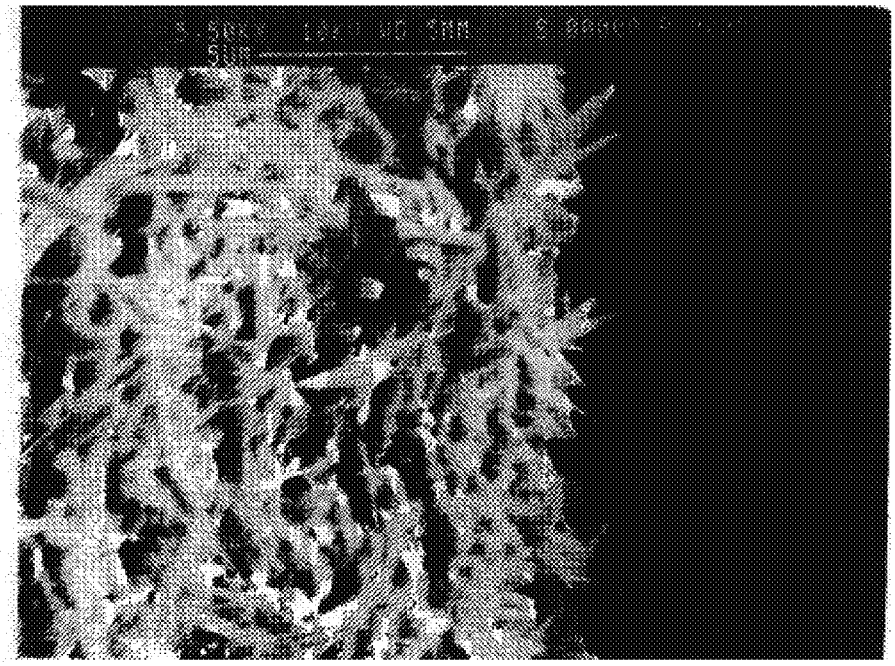
Figure 5C:
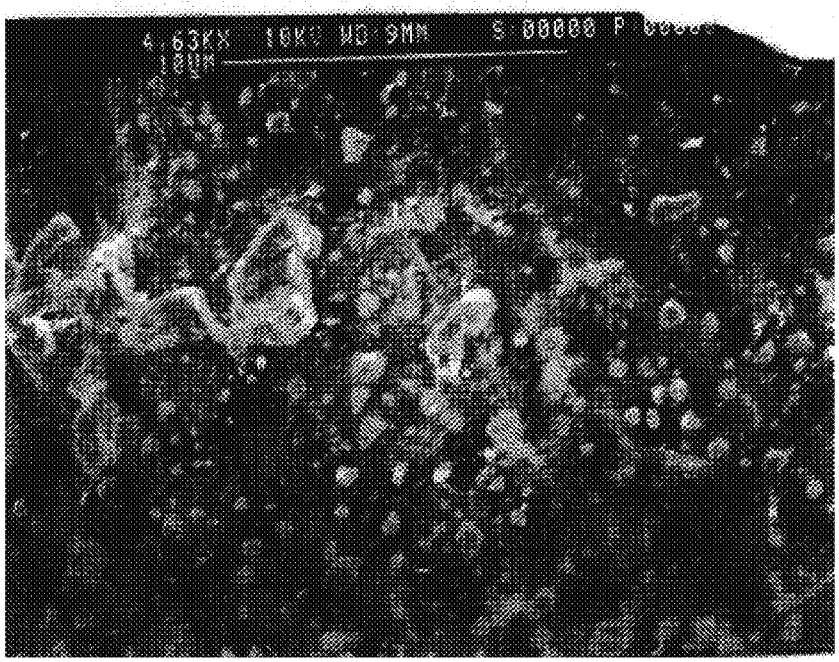
Figure 5D:
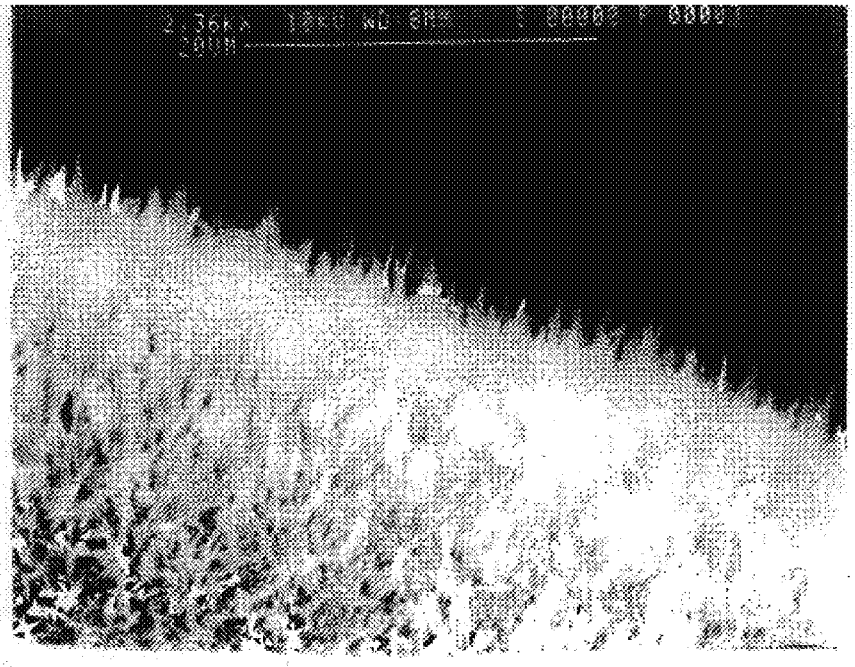

Electron emission was measured in the cylindrical test fixture described previously. Emission characteristics for the samples of these Examples are shown in FIG. 4. The onset of emission for the wire with the smaller diameter (Example 5) occurs at a lower voltage than that for the wire with the larger diameter (Example 6).

Examples 7–10

These examples show that the presence of a catalyst during the heating stage enables the use of a lower heating temperature to produce the metal-oxygen-carbon whiskers.

Iron wires 2 mil (0.05 mm) in diameter were coated with two layers of polyacrylonitrile. The wires used in Examples 7 and 8 were cleaned in acetone followed by a methanol rinse. The wires used in Examples 9 and 10, were also cleaned in acetone followed by a methanol rinse and were then were reduced in a 2 vol. %H/98 vol. % Ar atmosphere at 250° C. for 2 hours.

A viscous PAN solution, essentially identical to that used in Examples 1–4 and Comparative Experiment A, was then applied to the iron wires with a small brush. For the samples of Examples 7 and 8, the PAN layer coating on each wire was stabilized by heating in an oven at 250° C. for 30 minutes in an argon atmosphere. For the samples of Examples 9 and 10, the PAN layer coating on each wire was stabilized by heating in an oven at 250° C. for 30 minutes in a 2 vol. %H/98 vol. % Ar reducing atmosphere. A second PAN layer was brushed onto the stabilized first layer of each wire. For the samples of Examples 7 and 8, stabilization of the second PAN layer was carried out by heating in an oven at 250° C. for 30 minutes in an argon atmosphere. For the samples of Examples 9 and 10, stabilization of the second PAN layer was carried out by heating in an oven at 250° C. for 30 minutes in a 2 vol. %H/98 vol. % Ar reducing atmosphere.

The wire samples with the stabilized PAN coatings were placed in a 6 inch (15 cm) long ceramic crucible and heated in a tube furnace to form the iron-oxygen-carbon whiskers. 100 mgr. of 50 wt. % Cu/50 wt. % Ni alloy (commercially available from Goodfellow Corporation, Cambridge, U. K.) were also placed in the crucible. Approximately 5 wt. % for the alloy was consumed during firing. For Example 7, the coated wire was heated in a $CO_2$ atmosphere to a temperature of 700° C. and maintained at that temperature for 60 minutes. For Example 8, the coated wire was heated in a 2 vol. % ethylene/98 vol. % argon atmosphere to a temperature of 750° C. and maintained at that temperature for 120 minutes. For Example 9, the coated wire was heated in a CO atmosphere to a temperature of 700° C. and maintained at that temperature for 60 minutes. For Example 10, the coated wire was heated in a 2 vol. % ethylene/98 vol. % argon atmosphere at 550° C. and maintained at that temperature for 90 minutes.

Electron diffraction results for these samples indicate that the iron-oxygen-carbon whiskers are a crystalline ordered composition grown directly on and attached to the iron metal wire. The scanning electron micrographs for the samples of these Examples are shown in FIG. 5 (5*a*—Example 7, 5*b*—Example 8, 5*c*—Example 9, 5*d*—Example 10).

Figure 6:
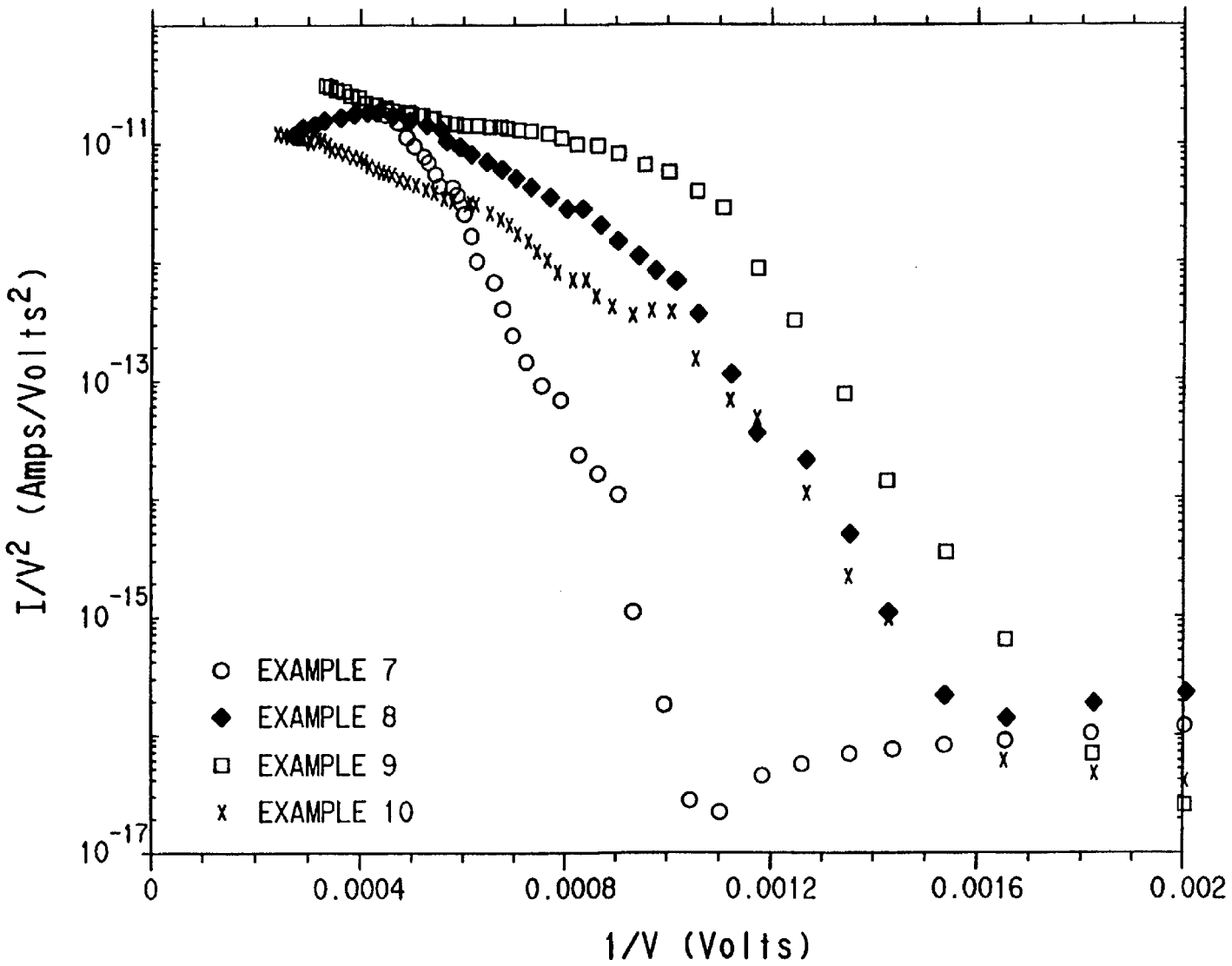
FIG. 6 is a plot of emission characteristics for the tungsten-oxygen-carbon whisker-coated tungsten wires shown in FIG. 5.

Electron emission was measured in the cylindrical test fixture described previously. Emission characteristics for the samples of these Examples are shown in FIG. 6. The emission results show that emitters can be produced by lower temperature processing when heating is carried out in the presence of a catalyst. The results for Example 9 also show that a wire heated in a CO atmosphere has considerably higher emission.

Examples 11–13 and Comparative Experiment B

These Examples and Comparative Experiment B show that the dependence of formation of the tungsten-oxygen-carbon whiskers on the temperature of the heating and the emission properties associated with whisker formation correspond to differences in the surface composition as determined by energy dispersive X-rays.

The samples of Examples 11 and 12 were prepared essentially as described for Examples 5 and 6, respectively, and the results were essentially the same, i.e., the formation of tungsten-oxygen-carbon whiskers on tungsten wire 2 mil (0.05 mm) and tungsten wire 4 mil (0.1 mm) in diameter, respectively. For the sample of Example 13, a tungsten wire 4 mil (0.1 mm) in diameter was used. The wire was cleaned and coated with a PAN layer and the PAN layer stabilized essentially as were the samples of Examples 11 and 12 except that following the stabilization of the second PAN layer by heating in the oven at 250° C. for 30 minutes in air, an additional stabilization step was performed by heating in the oven at 550° C. for 30 minutes in air. The sample for Comparative Experiment B was prepared essentially as those for Examples 5 and 11 except that the final heating was carried out at 1000° C. for 30 minutes in an argon atmosphere rather than at 1300° C.

Figure 7:
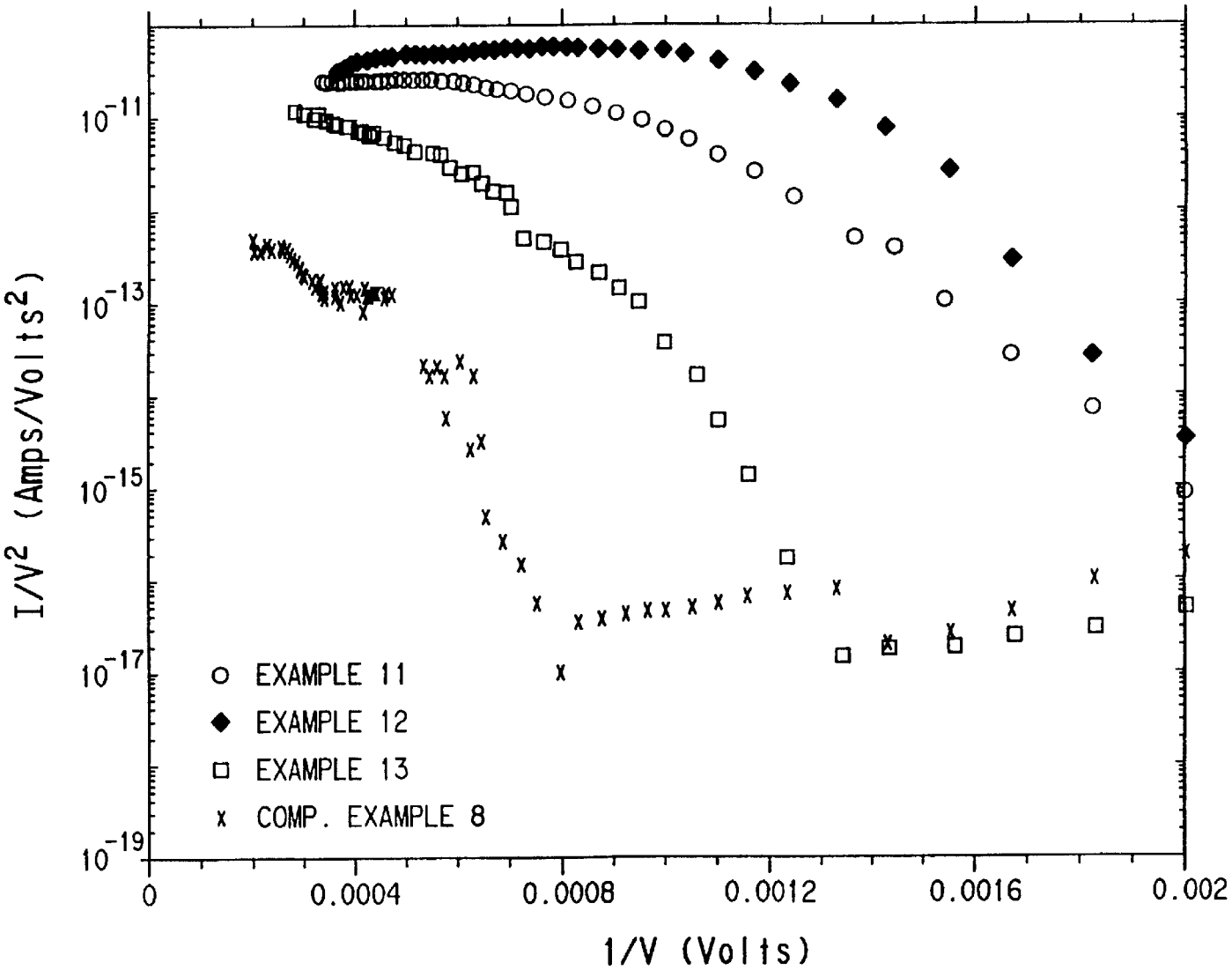
FIG. 7 is a plot of emission characteristics for polyacrylonitrile coated tungsten wires after being heated.

The samples of Examples 11–13 clearly show the formation of whiskers; the sample of Comparative Experiment B does not. The lack of that morphology in Comparative Experiment B is reflected in both emission characteristics and surface composition as determined by electron diffraction. Electron emission was measured in the cylindrical test fixture described previously. The heating temperature, surface composition expressed as atomic per cent of tungsten, oxygen and carbon, onset emission voltage and emission current at 2000 V are listed in Table 1. Emission characteristics for the samples of Examples 11–13 and Comparative Experiment B are shown in FIG. 7.

TABLE 1

| Sample | Heating Temp. (° C.) | Atomic % W | O | C | Voltage (V) | I (μA) |
|---|---|---|---|---|---|---|
| Example 11 | 1300 | 21.10 | 51.46 | 27.43 | 800 | 80 |
| Example 12 | 1300 | 24.03 | 42.51 | 33.45 | 750 | 150 |
| Example 13 | 1300 | 21.07 | 54.98 | 23.94 | 1400 | 25 |
| Comp. Ex. B | 1000 | 0.01 | 9.83 | 90.16 | 2900 | 0 |

Examples 14–15 and Comparative Experiment C

These examples illustrate the effect of polymer coating on surface morphology and electron emission characteristics.

In Examples 14 and 15 and Comparative Experiment C, iron wire 2 mil (0.05 mm) in diameter was cleaned with acetone followed by a methanol rinse and was reduced in a 2 vol. %H/98 vol. % argon atmosphere for 2 hours at 250° C.

For Comparative Experiment C. the uncoated iron wire was heated in the presence of a 55 wt. % Cu/45 wt. % Ni alloy catalyst in a CO atmosphere to a temperature of 550° C. and maintained at that temperature for 90 minutes.

In Example 14, the reduced wire was coated with a 6 wt. % solution of Elvaloy® 4043, a resin modifier (commercially available from E. I. du Pont de Nemours and Company, Wilmington, Del.) in methylene chloride. Elavaloy® is a copolymer of methylmethacrylate/ethylene and CO. The uncoated reduced wire of Example 15 was heated at 550° C. for 90 minutes in a CO atmosphere and in the presence of a 55 wt. % Cu/45 wt. % Ni catalyst. This wire was then coated with a 5 wt. % poly(methylmethacrylate) in methylene chloride solution to a thickness of 3 microns.

The coated wires of Examples 14 and 15 were then heated in the presence of a 55 wt. % Cu/45 wt. % Ni alloy catalyst in a CO atmosphere to a temperature of 550° C. and maintained at that temperature for 90 minutes.

Figure 8A:
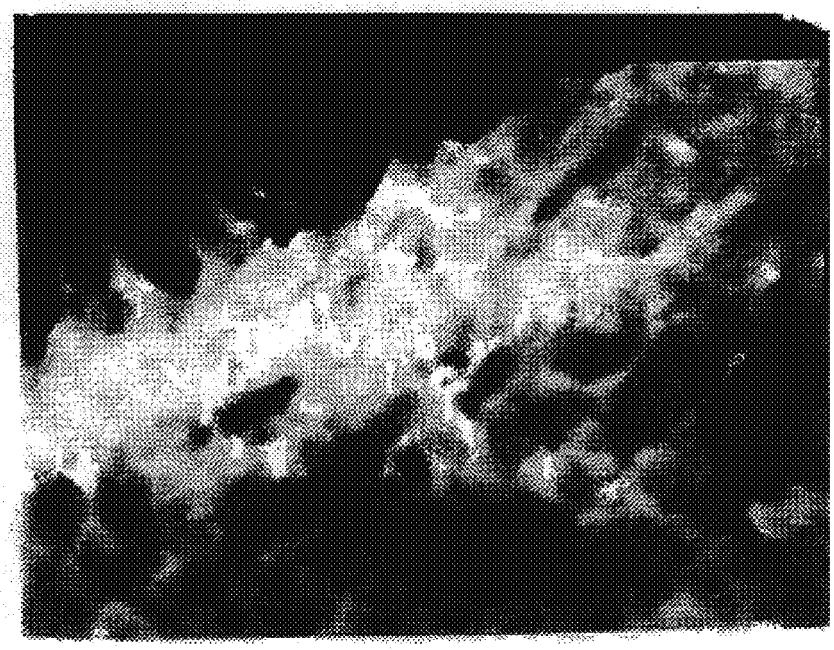
FIG. 8 shows the scanning electron micrographs of polymer coated and uncoated iron wires after being heated.
Figure 8B:
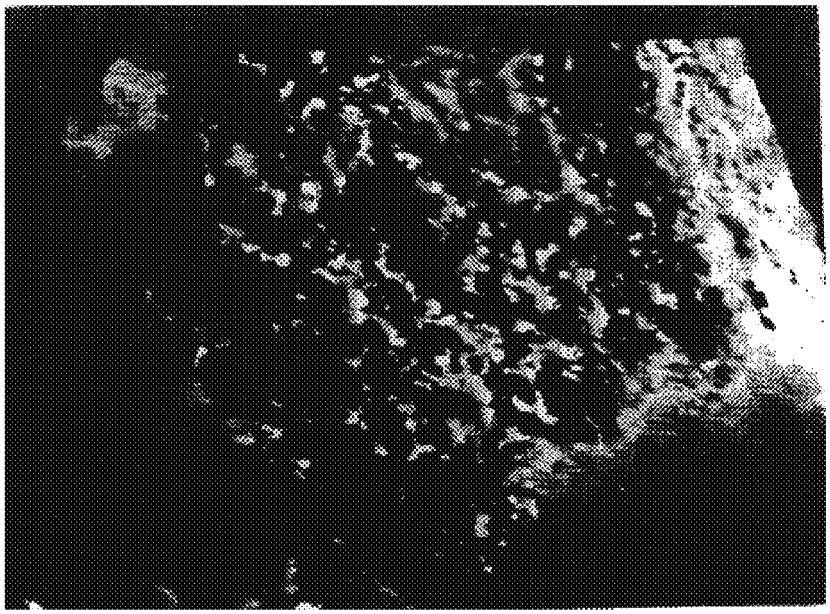
Figure 8C:
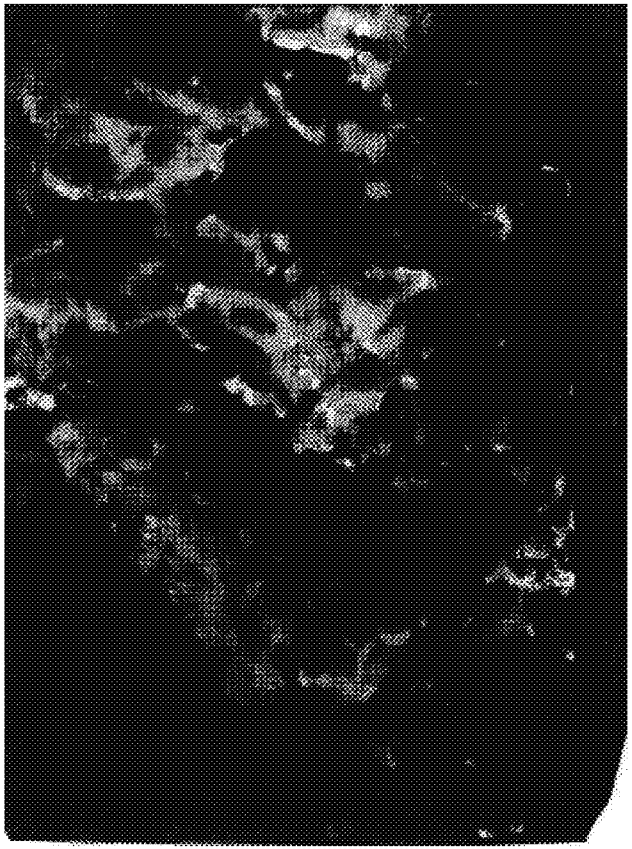
Figure 9:
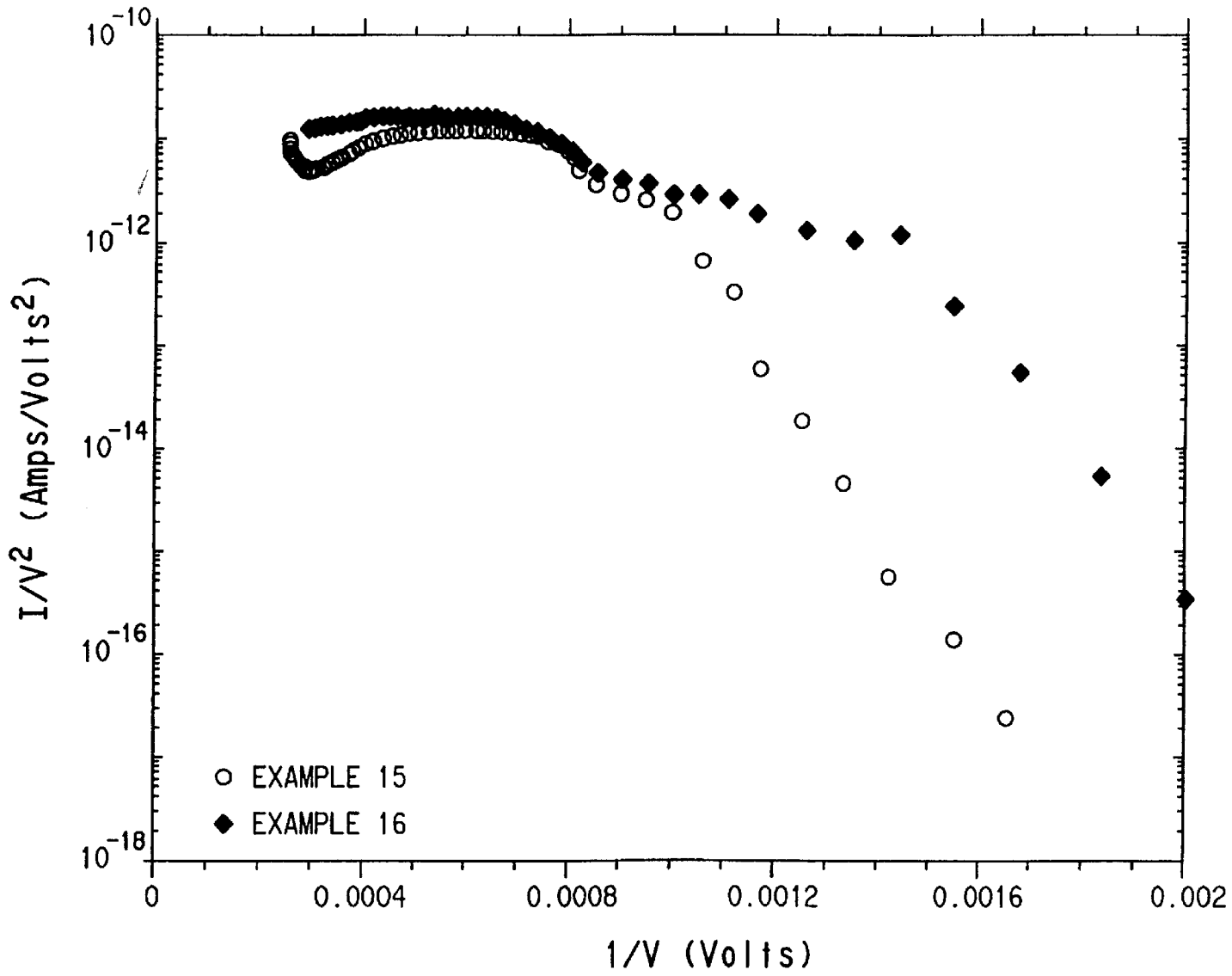
FIG. 9 is a plot of emission characteristics for the coated wires shown in FIG. 8.

The surface morphologies for the samples of these Examples are shown in FIG. 8 (8*a*—Comparative Experiment C, 8*b*—Example 14, 8*c*—Example 15). Electron emission was measured in the cylindrical test fixture described previously. The wire of Comparative Experiment C exhibited no emission in the voltage range studied. Emission characteristics for the samples of Examples 14 and 15 are shown in FIG. 9.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A field emission electron emitter composition comprising metal, oxygen and carbon, wherein the atomic ratio of metal:oxygen:carbon is a:b:c where a is from 0.1 to 0.4, b is from 0.1 to 0.8 and c is from 0.05 to 0.8 with the provisio that a+b+c=1.

2. The field emission electron emitter composition of claim 1, wherein a is from 0.2 to 0.4, b is from 0.4 to 0.8 and c is from 0.05 to 0.3 with the provisio that a+b+c=1.

3. The field emission electron emitter composition of claim 1 or 2, wherein said composition is in the form of whiskers.

4. The field emission electron emitter composition of claim 3, wherein said metal is tungsten, iron or molybdenum.

5. A field emission cathode comprising a field emission electron emitter composition comprising metal, oxygen and carbon attached to a substrate of the same metal, wherein the atomic ratio of metal:oxygen:carbon in said composition is a:b:c where a is from 0.1 to 0.4, b is from 0.1 to 0.8 and c is from 0.05 to 0.8 with the provisio that a+b+c=1.

6. The field emission cathode of claim 5, wherein a is from 0.2 to 0.4, b is from 0.4 to 0.8 and c is from 0.05 to 0.3 with the provisio that a+b+c=1.

7. The field emission cathode of claim 5 or 6, in which said substrate is in the form of a wire.

8. The field emission cathode of claim 7, wherein said composition is in the form of whiskers.

9. The field emission cathode of claim 8, wherein said metal is tungsten, iron or molybdenum.

* * * * *